US005625439A

United States Patent [19]

Murakami

[11] Patent Number: 5,625,439

[45] Date of Patent: Apr. 29, 1997

[54] ELECTROPHOTOGRAPHIC RECORDING APPARATUS HAVING TONER DELIVERING MEMBER WITH LARGE WETTING ANGLE

[75] Inventor: Eisaku Murakami, Kanagawa, Japan

[73] Assignee: Ricoh Company, Ltd., Tokyo, Japan

[21] Appl. No.: 448,785

[22] Filed: May 24, 1995

[30] Foreign Application Priority Data

May 24, 1994 [JP] Japan ..... 6-109779
Apr. 11, 1995 [JP] Japan ..... 7-085591

[51] Int. Cl.[6] ..... G03G 15/06

[52] U.S. Cl. ..... 399/272

[58] Field of Search ..... 355/259, 256, 355/245

[56] References Cited

U.S. PATENT DOCUMENTS 3,486,922 12/1969 Cassiers et al. ..... 355/259 X 3,743,408 7/1973 Ohno ..... 355/256

*Primary Examiner*—Nestor R. Ramirez

*Attorney, Agent, or Firm*—Oblon, Spivak, McClelland, Maier & Neustadt, P.C.

[57] ABSTRACT

An electrophotographic recording apparatus includes an image supporting member for supporting an electrostatic latent image on its surface, and a developing unit for supplying one-component toner to the image supporting member. The developing unit has a toner delivering member for directly delivering toner to the image supporting member. The included wetting angle to water of the surface of the toner delivering member is more than 20 degrees.

24 Claims, 3 Drawing Sheets

ELECTROPHOTOGRAPHIC RECORDING APPARATUS HAVING TONER DELIVERING MEMBER WITH LARGE WETTING ANGLE

BACKGROUND OF THE INVENTION

1. Field of the Invention

The present invention relates to an electrophotographic recording apparatus used in an image forming apparatus such as a PPC (Plain Paper Copier) or a LP (Laser Printer). More particularly, the invention is concerned with a developing unit which has a toner delivering member. The toner delivering member delivers toner to an image supporting member.

2. Discussion of the Background

FIG. 1 is a schematic elevational view showing a conventional developing unit used in an electrophotographic recording apparatus. It includes a drum shaped photosensitive body 1, a developing unit 2, an agitator 3, a supplying member 4, a developing roller 5, a blade 6 for forming a thin layer and a housing 7. When the developing unit 2 is provided in a predetermining position of a electrophotographic recording apparatus, the developing roller 5 comes into contact with the photosensitive body 1. New developer comprising toner and an additive in the developing unit 2 is stirred by the agitator 3. The additive may be zinc stearate (a fatty acid) for preventing toner sticking and silica for enhancing toner fluidity. Developer is delivered to the developing roller 5 by the supplying member 4.

The developing roller 5 has a conductive core body. The surface of the conductive core body is coated with resin, and is magnetized. Developer is attracted to the surface of the developing roller 5 to form a developer layer thereon. The developer layer is limited to a thin layer by the blade 6, and is charged by friction. Frictionally charged toner on the surface of the developing roller 5 is electrically transferred and adhered to an electrostatic latent image formed on the surface of the photosensitive body 1. The electrostatic latent image on the surface of the photosensitive body 1 is developed.

However, in the developing unit shown in FIG. 1, when inversely charged toner is adhered to the developing roller 5, it is transferred to an area outside of the electrostatic latent image's area on the photosensitive body 1. This therefore raises a problem of contamination on the background of the recording paper. As schematically shown in FIG. 2, a developing unit constructed with an intermediate roller 8 and a developing roller 5 has been proposed to solve the above mentioned problem. The intermediate roller 8 has a conductive core body and an elastic surface layer. A charging roller 9 charges a surface of the photosensitive body 1 uniformly and a transfer roller 10 transfers a developed electrostatic latent image to a recording paper (not shown).

The same members or the members having the same function in the developing unit shown in FIG. 1 have the same reference numeral in FIG. 2, and their detailed explanation is omitted here.

In the developing unit shown in FIG. 1, toner on the developing roller 5 is directly attached to the electrostatic latent image on the photosensitive body 1, and the electrostatic latent image is developed. In the developing unit shown in FIG. 2, toner on the developing roller 5 is attached to the electrostatic latent image on the photosensitive body 1 via the intermediate roller 8, and the electrostatic latent image is developed. The developing unit shown in FIG. 2 prevents contamination of the background of the recording paper due to inversely charged toner. As the surface of the intermediate roller 8 is elastic, the electrostatic latent image can be developed without stressing the photosensitive body 1.

FIG. 3 is a chart showing a relationship between the recording paper number and the concentration of the additive in the developing unit in FIG. 2. As shown in FIG. 3, when an endurance test was performed on the developing unit shown in FIG. 2, the concentration of the additive in the developer within the developing unit gradually increased over time. Especially the concentration of the additive at the area P in FIG. 1 (at an approximately lower portion of the blade 6) increased.

Particles of zinc stearate are larger than those of toner, and are charged in inverse polarity to that of toner. The particles of zinc stearate clump to one another so as to become large particles which are charged in inverse polarity to that of the toner, thereby attracting toner. This toner thus cannot be transferred to the photosensitive body 1. Image quality is therefore deteriorated, due to poor printing of the image or contamination of the background.

The additive must therefore be removed from the developer. Two methods for removing additive from the developing unit may be considered:

(a) a removing unit for removing additive from the developing unit is provided in the developing unit.

(b) toner and additive are transferred to the photosensitive body during the developing process, and are collected by the cleaning unit.

In view of compactness and cost reduction for the developing unit, method (b) is preferable.

A cause of the additive concentration increase in FIG. 1 is explained hereinafter. The additive attaches to the surface of the developing roller 5 directly or via water molecules in the air. The additive is not transferred to the photosensitive body 1 and remains on the surface of the developing roller 5. Toner is transferred to the photosensitive body 1 from the developing roller 5. As residual toner and additive are removed from the developing roller 5 by the blade 6, additive concentration at the area P increases.

A cause of additive concentration increase at an approximately lower portion of the blade 6 in FIG. 2 is explained hereinafter. When the additive is strongly attached to the surface of the intermediate roller 8, the additive is not transferred to the photosensitive body 1 and remains on the surface of the intermediate roller 8. The intermediate roller 8 is rotated in the inverse direction to that of rotation of the developing roller 5. Additive is removed from the developing roller 5 at the nip portion between the intermediate roller 8 and the developing roller 5, and remains at an approximately lower portion of the blade 6.

FIG. 4 is a chart showing a relationship between the recording paper number and the aggregation of toner in the developing unit in FIG. 2. In FIG. 4, when the additive concentration in the developing unit 2 increases, toner in the developing unit 2 is aggregated and the fluidity of the toner becomes poor. The toner supplying amount to the intermediate roller 8 decreases while the additive supplying amount to the intermediate roller 8 increases. The toner/additive ratio on the intermediate roller 8 thereby decreases.

FIG. 5 is a chart showing a relationship between the recording paper number and the image quality in the developing unit in FIG. 2. In FIG. 5, level 5 indicates high quality printing in a recorded image. Level 1 indicates poor printing and missing fine lines in a recorded image. In FIG. 5 a recorded image deterioration is exemplified by low toner concentrations in large black areas, and missing of fine lines in the recording image. The recorded image is similarly deteriorated in the developing unit in FIG. 1.

The above mentioned problem is a defect in the one-component toner developing method.

SUMMARY OF THE INVENTION

It is therefore an object of the present invention provide an electrophotographic recording apparatus which is capable of preventing the additive concentration from increasing over time.

It is another object of the present invention to provide an electrophotographic recording apparatus which is capable of preventing the recorded image quality from deteriorating, such as a toner concentration decrease in a large black area, and missing fine lines in the recording image.

In order to achieve the above mentioned objects, according to the present invention, there is provided an electrophotographic recording apparatus including an image supporting member for supporting an electrostatic latent image on its surface, and a developing unit for supplying one-component toner to the image supporting member. The developing unit has a toner delivering member for directly delivering toner to the image supporting member. The included wetting angle to water of the surface of the toner delivering member is more than 20 degrees.

BRIEF DESCRIPTION OF THE DRAWINGS

The above and other objects, features and advantages of the present invention will become more apparent from the following detailed description when considered in connection with the accompanying drawings in which.

DESCRIPTION OF THE PREFERRED EMBODIMENTS

Figure 1:
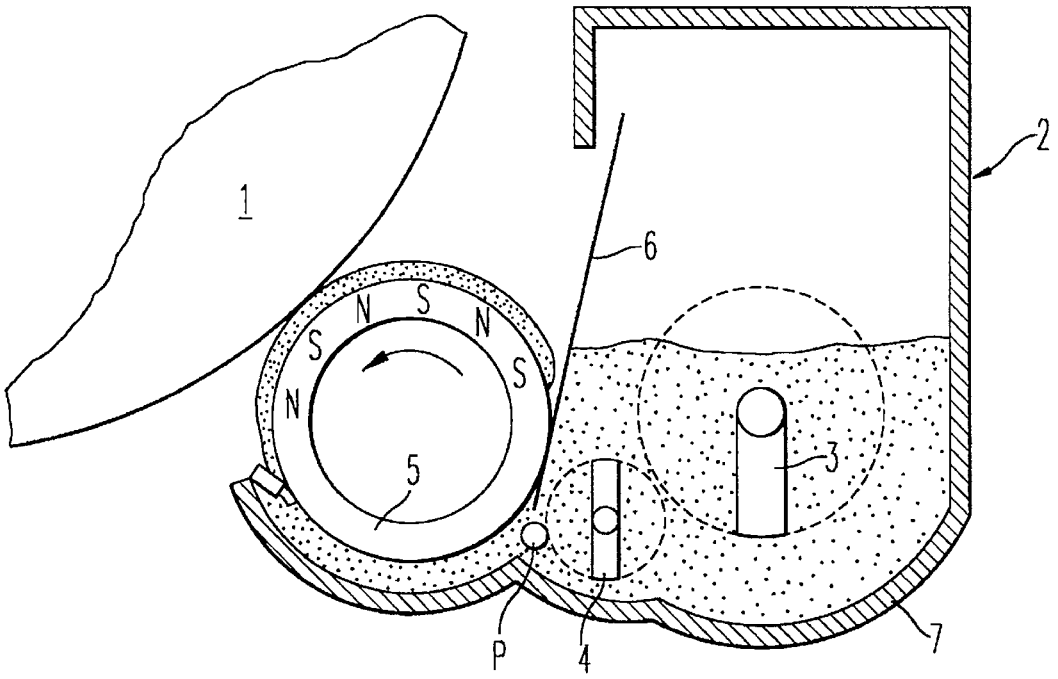
FIG. 1 is a schematic elevational view showing a conventional developing unit used in an electrophotographic recording apparatus.

Referring now to the drawings, wherein like reference numerals designate identical or corresponding parts throughout the several views, first embodiment of the present invention is explained hereinafter.

In the first embodiment, a developing unit in FIG. 1 has a developing roller 5 which is a toner delivering member. A surface of the developing roller 5 is coated with resin including fluorine or silicon. The included wetting angle to water of the coated surface of the developing roller 5 is more than 20 degrees.

Figure 6A:
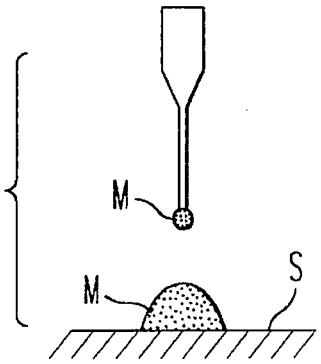
FIG. 6 is an illustration of a method for measuring the wetting angle.
Figure 6B:
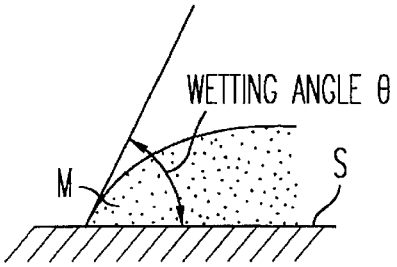

FIG. 6 is an illustration of a method for measuring the wetting angle, as follows. In FIG. 6(*a*), a sample surface S is horizontally fixed to a measuring apparatus for the wetting angle. A reagent M (10 μg) is dropped on the sample surface S using a filler or an injector while the sample surface S is observed with a magnifying glass. The reagent M is water purified by an ion-exchange process. The reagent M dropped on the sample surface S spreads to a greater or lesser degree, and so forms a drop having a certain shape, due to surface tension. As the drop of reagent spreads, the included angle θ between the horizontal surface S and edge portion of the reagent drop changes.

As seen in FIG. 6(*b*), the wetting angle of the reagent to the surface S may be measured by measuring the included angle θ between the horizontal surface S and edge portion of the reagent. The wetting angle is defined as the included angle θ as so measured. A large value of the angle θ means that the reagent M beads up and easily rolls off of the sample surface S. A small value of the angle θ means that the reagent M spreads to a large degree and does not easily roll off of the sample surface. As a result of measurements, it has been found that when the included wetting angle for water of the coated surface of the developing roller 5 is more than 20 degrees, an affinity between the surface of the developing roller 5 and water is sufficiently low that the molecules of water do not attach to the surface of the developing roller, and so the additive in the developer does not attach to the surface of the developing roller 5 via the molecules of water. Toner can thus stably be supplied to the photosensitive body 1 under severe conditions such as high humidity.

A second embodiment of the present invention is explained hereinafter. In the second embodiment, the included wetting angle to oleic acid of the coated surface of the developing roller 5 is more than 20 degrees. The method for measuring the wetting angle is the same as the method for measuring the wetting angle for water shown in FIG. 6, except that the reagent M is oleic acid. As a result of measurements, it has been found that when the included wetting angle to oleic acid of the coated surface of developing roller 5 is more than 20 degrees, additives in the developer (oleic acid, like zinc stearate, is a fatty acid and is in a fluid state at normal temperatures) does not attach to the surface of the developing roller 5, and does not remain on its surface. Toner can thus stably be supplied to the photosensitive body 1.

The third embodiment of the present invention is explained hereinafter. In the third embodiment, a developing unit in FIG. 2 has an intermediate roller 8 which is a toner developing member. A surface of the intermediate roller 8 is coated with resin including fluorine or silicon. The included wetting angle to water of the coated surface of the intermediate roller 8 is more than 20 degrees. As a result of measurements, it has been found that when the included wetting angle to water of the coated surface of the intermediate roller 8 is more than 20 degrees, additive in the developer which is transferred by the developing roller 5 does not attach to the surface of the intermediate roller 8 via molecules of water. Toner can thus stably be supplied to the photosensitive body 1 under severe conditions such as high humidity, just as in the first embodiment.

A fourth embodiment of the present invention is explained hereinafter. In the fourth embodiment, the included wetting angle to oleic acid of the coated surface of the intermediate roller 8 is more than 20 degrees.

Figure 2:
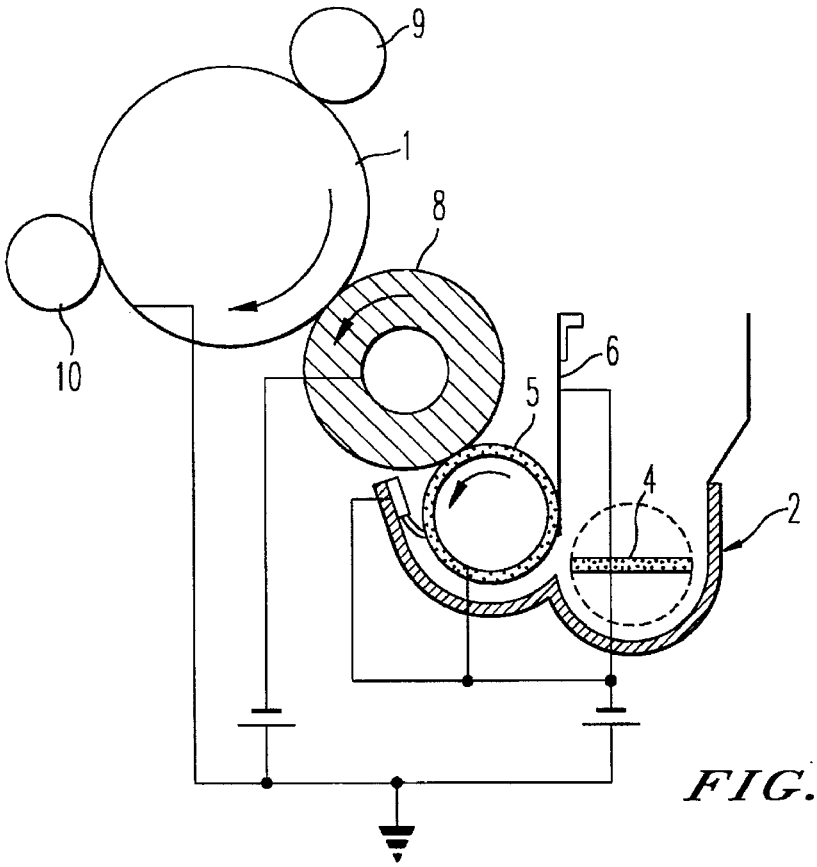
FIG. 2 is a schematic elevational view showing a conventional developing unit with an intermediate roller and a developing roller used in an electrophotographic recording apparatus.
Figure 3:
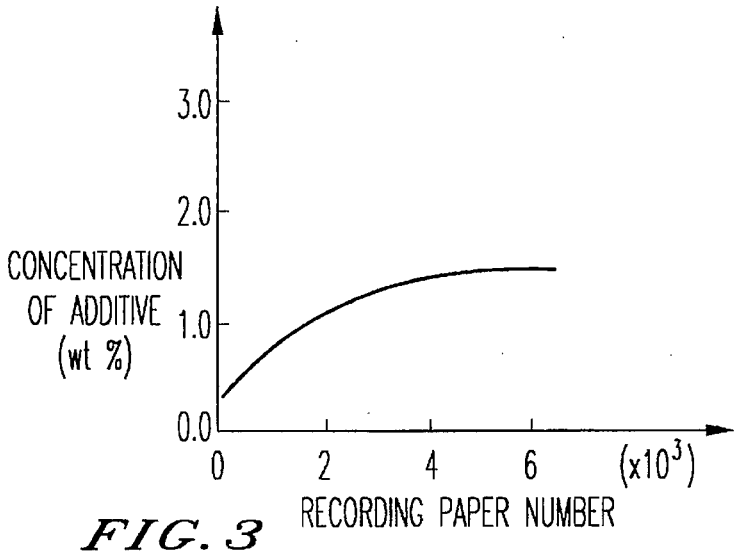
FIG. 3 is a chart showing a relationship between the recording paper number and concentration of additive in the developing unit in FIG. 2.
Figure 4:
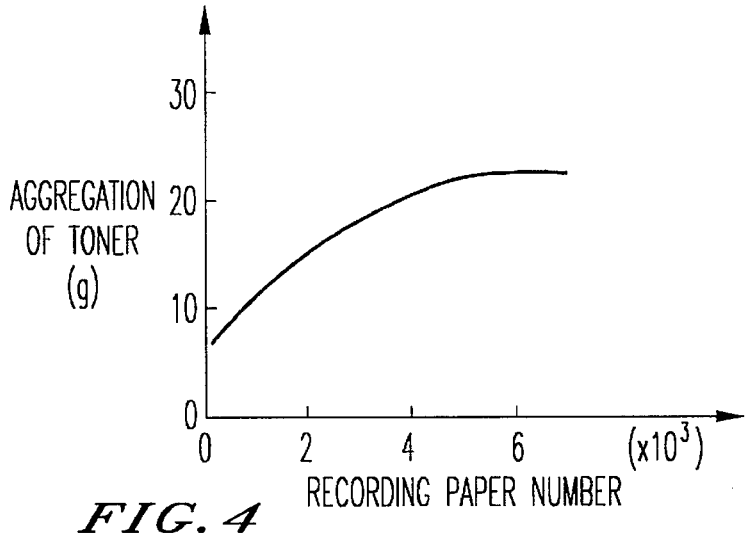
FIG. 4 is a chart showing a relationship between the recording paper number and aggregation of toner in the developing unit in FIG. 2.
Figure 5:
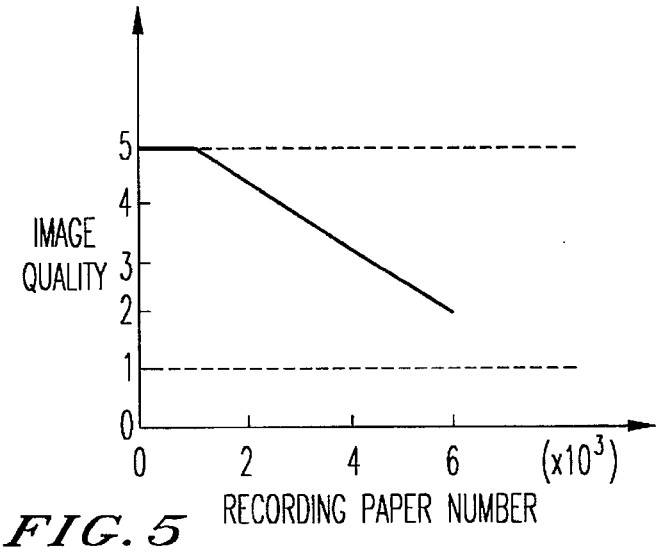
FIG. 5 is a chart showing a relationship between the recording paper number and image quality in the developing unit in FIG. 2.
Figure 7:
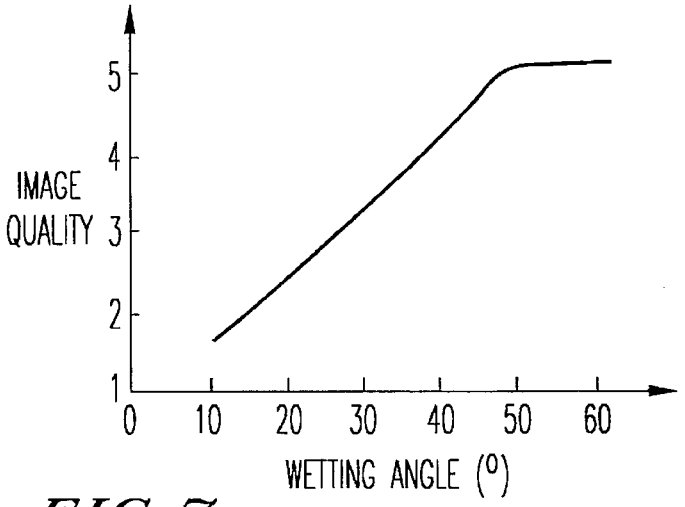
FIG. 7 is a chart showing a relationship between wetting angle and image quality in the developing unit in FIG. 2.

FIG. 7 is a chart showing a relationship between the wetting angle and image quality in the developing unit in FIG. 2. FIG. 7 shows the results of an endurance test performed by using poor developer which causes poor printing (the amount of additives in the developer is larger than that of toner), for intermediate rollers which have different wetting angles to oleic acid. As shown in FIG. 7, the image quality is high for the intermediate roller having a surface with a large wetting angle, especially for a wetting angle larger than about 50°.

Figure 8:
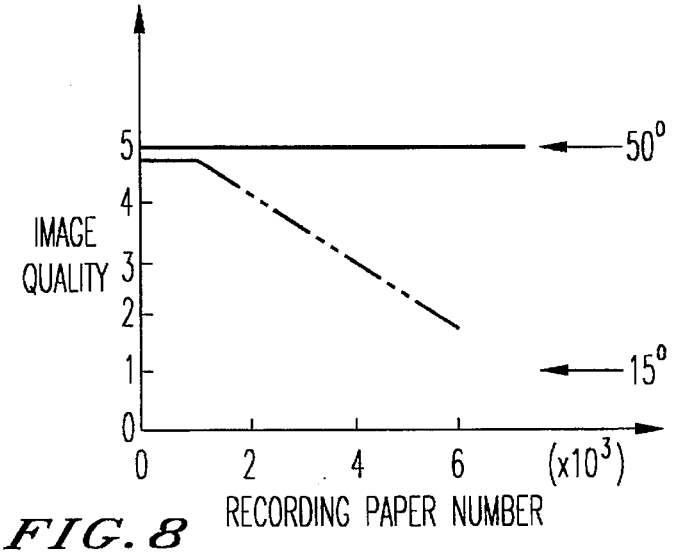
FIG. 8 is a chart showing a relationship between a recording paper number and image quality in the developing unit in FIG. 2 as modified according to the invention.

FIG. 8 is a chart showing a relationship between the recording paper number and image quality in the developing unit in FIG. 2. FIG. 8 shows a result of endurance tests performed using an intermediate roller 8 which has a small wetting angle to oleic acid of 15° (chain line) and an intermediate roller 8 which has a large wetting angle to oleic acid of 50° (solid line) for 60,000 recording papers.

As shown in FIG. 8, the level of image quality deteriorates over time for the intermediate roller having the surface with a small wetting angle, but the image quality remains high over time for the intermediate roller having a surface with a large wetting angle. As a result of measurements, it has been found that when the included wetting angle to oleic acid of the coated surface of the intermediate roller 8 is more than 20 degrees, additive in the developer which is transferred by the developing roller 5 does not attach to the surface of the intermediate roller 8, and does not remain on its surface, just as in the second embodiment.

In first and third embodiments, the included wetting angle to water of the surface of the developing roller 5 in FIG. 1 or of the intermediate roller 8 in FIG. 2 is more than 20 degrees. It is thus difficult for water to attach to the surface of the developing roller 5 or to the intermediate roller 8. It is also difficult for the additive to attach to the surface of the developing roller 5 or the intermediate roller 8 via water. Therefore, in the developing process, both additive and toner are transferred to the photosensitive body 1, and the additive, as well as residual toner, are collected by a cleaning unit (not shown). The additive does not remain in the developing unit and the ratio of toner/additive in the developer remains within a predetermined range.

In second and fourth embodiments, the included wetting angle to oleic acid of the surface of the developing roller 5 in FIG. 1 or of the intermediate roller 8 in FIG. 2 is again more than 20 degrees. It is therefore difficult for the zinc stearate to directly attach to the surface of the developing roller 5 or the intermediate roller 8.

In the developing process using the invention, zinc stearate and toner are transferred to the photosensitive body, and are collected by the cleaning unit (not shown). Zinc stearate does not remain in the developing unit. In the present embodiments, the surface of the developing roller 5 in FIG. 1 or of the intermediate roller 8 in FIG. 2 is coated with resin including fluorine or silicon. So long as the above mentioned of wetting angle condition is satisfied, the surface of the developing roller 5 in FIG. 1 or of the intermediate roller 8 in FIG. 2 may be coated with rubber material. By using rubber material, the developing roller 5 in FIG. 1 of or the intermediate roller 8 in FIG. 2 softly comes into contact with the photosensitive body 1, which increases the life of the photosensitive body 1.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by letters patent of the United States is:

1. An electrophotographic recording apparatus comprising:

an image supporting member for supporting an electrostatic latent image on a surface thereof; and a developing unit for supplying a one-component toner to said image supporting member, said developing unit having a toner delivering member for directly delivering toner to said image supporting member, wherein an included wetting angle to water of a surface of said toner delivering member is more than 20 degrees.

2. The electrophotographic recording apparatus according to claim 1 wherein the included wetting angle to water of a surface of said toner delivering member is less than about 50 degrees.

3. An electrophotographic recording apparatus comprising:

an image supporting member for supporting an electrostatic latent image on a surface thereof; and a developing unit for supplying a one-component toner to said image supporting member, said developing unit having a toner delivering member for directly delivering toner to said image supporting member, wherein an included wetting angle to oleic acid of a surface of said toner delivering member is more than 20 degrees, inclusive.

4. The electrophotographic recording apparatus according to claim 3 wherein the included wetting angle to oleic acid of a surface of said toner delivering member is less than about 50 degrees.

5. An electrophotographic recording apparatus comprising:

an image supporting member for supporting an electrostatic latent image on a surface thereof; and a developing unit for supplying one-component toner to said image supporting member, said developing unit having a toner delivering member with a coated layer for directly delivering toner to said image supporting member, wherein an included wetting angle to water of a surface of said coated layer of said toner delivering member is more than 20 degrees.

6. An electrophotographic recording apparatus according to claim 5 wherein said coated layer of said toner delivering member is made of resin including fluorine.

7. An electrophotographic recording apparatus according to claim 5 wherein said coated layer of said toner delivering member is made of resin including silicon.

8. An electrophotographic recording apparatus according to claim 5 wherein said coated layer of said toner delivering member is made of rubber material.

9. The electrophotographic recording apparatus according to claim 5 wherein the included wetting angle to water of a surface of said toner delivering member is less than about 50 degrees.

10. An electrophotographic recording apparatus comprising:

an image supporting member for supporting an electrostatic latent image on a surface thereof; and a developing unit for supplying one-component toner to said image supporting member, said developing unit having a toner delivering member with a coated layer for directly delivering toner to said image supporting member, wherein an included wetting angle to oleic acid of a surface of said coated layer of said toner delivering member is more than 20 degrees.

11. An electrophotographic recording apparatus according to claim 10 wherein said coated layer of said toner delivering member is made of resin including fluorine.

12. An electrophotographic recording apparatus according to claim 10 wherein said coated layer of said toner delivering member is made of resin including silicon.

13. An electrophotographic recording apparatus according to claim 10 wherein said coated layer of said toner delivering member is made of rubber material.

14. The electrophotographic recording apparatus according to claim 10 wherein the included wetting angle to oleic acid of a surface of said toner delivering member is less than about 50 degrees.

15. An electrophotographic recording apparatus comprising:

an image supporting member for supporting an electrostatic latent image on a surface thereof; and a developing unit for supplying one-component toner to said image supporting member, said developing unit having a first toner delivering member, a second toner delivering member with a coated layer, and a toner restricting member, wherein said first toner delivering member delivers toner to said second toner delivering member, said second toner delivering member delivers toner from said first toner delivering member to said image supporting member, and said toner restricting member restricts the amount of toner which is delivered from said first toner delivering member to said second toner delivering member, and wherein an included wetting angle to water of a surface of said coated layer of said second toner delivering member is more than 20 degrees.

16. An electrophotographic recording apparatus according to claim 15 wherein said coated layer of said second toner delivering member is made of resin including fluorine.

17. An electrophotographic recording apparatus according to claim 15 wherein said coated layer of said second toner delivering member is made of resin including silicon.

18. An electrophotographic recording apparatus according to claim 15 wherein said coated layer of said second toner delivering member is made of rubber material.

19. The electrophotographic recording apparatus according to claim 15 wherein the included wetting angle to water of a surface of said toner delivering member is less than about 50 degrees.

20. An electrophotographic recording apparatus comprising:

an image supporting member for supporting an electrostatic latent image on a surface thereof; and a developing unit for supplying one-component toner to said image supporting member, said developing unit having a first toner delivering member, a second toner delivering member with a coated layer, and a toner restricting member, wherein said first toner delivering member delivers toner to said second toner delivering member, said second toner delivering member delivers toner from said first toner delivering member to said image supporting member, and said toner restricting member restricts the amount of toner which is delivered from said first toner delivering member to said second toner delivering member, and wherein an included wetting angle to oleic acid of a surface of said coated layer of said second toner delivering member is more than 20 degrees.

21. An electrophotographic recording apparatus according to claim 20 wherein said coated layer of said second toner delivering member is made of resin including fluorine.

22. An electrophotographic recording apparatus according to claim 20 wherein said coated layer of said second toner delivering member is made of resin including silicon.

23. An electrophotographic recording apparatus according to claim 20 wherein said coated layer of said second toner delivering member is made of rubber material.

24. The electrophotographic recording apparatus according to claim 20 wherein the included wetting angle to oleic acid of a surface of said toner delivering member is less than about 50 degrees.

* * * * *